US010816155B2

(12) United States Patent
Cumme et al.

(10) Patent No.: US 10,816,155 B2
(45) Date of Patent: Oct. 27, 2020

(54) LIGHTING DEVICE FOR A VEHICLE

(71) Applicant: Carl Zeiss Jena GmbH, Jena (DE)

(72) Inventors: Matthias Cumme, Jena (DE); Arnaud Deparnay, Erfurt (DE)

(73) Assignee: CARL ZEISS JENA GMBH, Jena (DE)

( * ) Notice: Subject to any disclaimer, the term of this patent is extended or adjusted under 35 U.S.C. 154(b) by 0 days.

(21) Appl. No.: 16/334,048

(22) PCT Filed: Sep. 20, 2017

(86) PCT No.: PCT/EP2017/073798
§ 371 (c)(1),
(2) Date: Mar. 18, 2019

(87) PCT Pub. No.: WO2018/054986
PCT Pub. Date: Mar. 29, 2018

(65) Prior Publication Data

US 2019/0271446 A1 Sep. 5, 2019

(30) Foreign Application Priority Data

Sep. 23, 2016 (DE) ..... 10 2016 117 967

(51) Int. Cl.
*F21S 41/141* (2018.01)
*F21S 41/33* (2018.01)
(Continued)

(52) U.S. Cl.
CPC ..... *F21S 41/141* (2018.01); *F21S 41/16* (2018.01); *F21S 41/285* (2018.01); *F21S 41/33* (2018.01); *F21S 43/26* (2018.01)

(58) Field of Classification Search
CPC ..... F21S 41/141; F21S 41/33; F21S 41/16; F21S 41/285; F21S 43/26; F21S 41/14; F21S 41/00; F21S 41/10; F21S 41/12; F21S 41/32; B60Q 1/04; B60Q 1/22; F21W 2102/00; F21W 2102/20; F21W 2103/45
See application file for complete search history.

(56) References Cited

U.S. PATENT DOCUMENTS 5,963,345 A 10/1999 Smith
7,088,483 B1 8/2006 Efimov
(Continued)

FOREIGN PATENT DOCUMENTS

DE 19623749 A1 5/1997
DE 102005019257 A1 11/2006
(Continued)

OTHER PUBLICATIONS

Brenner, K-H., et al., "Design and Fabrication of Arbitrary, non-Separable Continuous Phase Elements", OSA/DOMO 2000, 2000, pp. 237-239.
(Continued)

*Primary Examiner* — Bao Q Truong
(74) *Attorney, Agent, or Firm* — Murphy, Bilak & Homiller, PLLC

(57) ABSTRACT

Lighting devices for vehicles, e.g., headlamps or tail lamps, are provided. A refractive diffuser (50) allows the provision of substantially any lighting signature for the lighting device, yielding great freedoms in terms of design.

10 Claims, 9 Drawing Sheets

(51) Int. Cl.

| | |
|---|---|
| ***F21S 41/16*** | (2018.01) |
| ***F21S 41/20*** | (2018.01) |
| ***F21S 43/20*** | (2018.01) |

(56) References Cited

U.S. PATENT DOCUMENTS

| | | | | |
|---|---|---|---|---|
| 8,704,256 | B2 * | 4/2014 | Sekii | F21V 5/04 257/98 |
| 9,091,407 | B2 | 7/2015 | Dubosc et al. | |
| 2002/0034710 | A1 | 3/2002 | Morris et al. | |
| 2002/0145797 | A1 | 10/2002 | Sales | |
| 2005/0078486 | A1 | 4/2005 | Kawaguchi | |
| 2012/0229611 | A1 | 9/2012 | Pellman et al. | |
| 2013/0010487 | A1 | 1/2013 | Buisson | |
| 2013/0116049 | A1 * | 5/2013 | Pellman | A63F 13/213 463/32 |
| 2013/0147353 | A1 * | 6/2013 | Mandelboum | H05B 45/10 315/119 |
| 2014/0085916 | A1 | 3/2014 | Dubosc et al. | |
| 2015/0219908 | A1 * | 8/2015 | Lee | G02B 30/00 359/463 |
| 2015/0232018 | A1 | 8/2015 | Augst | |

FOREIGN PATENT DOCUMENTS

| | | | |
|---|---|---|---|
| DE | 102007045332 | A1 | 3/2009 |
| DE | 102009053571 | A1 | 5/2011 |
| DE | 102011051734 | A1 | 3/2012 |
| DE | 102013003441 | A | 9/2014 |
| DE | 102014204535 | A1 | 10/2015 |
| EP | 0950848 | A2 | 10/1999 |
| EP | 1916471 | A1 | 4/2008 |
| EP | 2336632 | A1 | 6/2011 |
| EP | 2587113 | A1 | 5/2013 |
| EP | 2905530 | A1 | 8/2015 |
| EP | 2276076 | B1 | 3/2016 |
| FR | 2919913 | A1 | 2/2009 |
| FR | 2995978 | A1 | 3/2014 |
| WO | 2011113937 | A1 | 9/2011 |
| WO | 2014106584 | A1 | 7/2014 |
| WO | 2015173814 | A2 | 11/2015 |

OTHER PUBLICATIONS

Cumme, Matthias, et al., "From Regular Periodic Micro-lens Arrays to Randomized Continuous Phase Profiles", Adv. Opt Techn, 2015, pp. 47-61.

Makowski, Michal, et al., "Simple Holographic Projection in Color", Optical Society of America, vol. 20, No. 22, Oct. 22, 2012, pp. 25130-25136.

Néauport, Jérôme, et al., "Design and Optical Characterization of a Large Continuous Phase Plate for Laser Integration Line and Laser Megajoule Facilities", Optical Society of America, Applied Optics, vol. 42, No. 13, May 1, 2003, pp. 2377-2382.

Reichel, Steffen, et al., "Glass Micro-Optics for Laser Beam Shaping and LED Collimation", Conference Paper, Optical Fabrication and Testing, Jackson Hole, Wyoming United States, Jun. 13-17, 2010, 3 pages.

Ruffieux , et al., "Two step process for the fabrication of diffraction limited concave microlens arrays", Optical Society of America, vol. 16, No. 24, 2008, 9 pages.

* cited by examiner

LIGHTING DEVICE FOR A VEHICLE

TECHNICAL FIELD

The present application relates to lighting devices for vehicles, for example lighting devices that are usable as headlamps, tail lamps, stop lamps or direction indicators.

BACKGROUND

On account of their spectral properties and the collimation properties that are significantly improved in comparison with conventional incandescent lamps, light sources, such as light-emitting diodes, white-light light-emitting diodes, laser diodes or phosphor targets excited by laser light, for example, which are used in modern lighting devices of vehicles, e.g., motor vehicles, offer an extension to the application potential of such light sources; however, on the other hand, they also require adapted optical concepts in order, for example, to meet legal requirements for lighting devices in vehicles.

Thus, for example, the point light source properties of the systems made of laser diode and phosphor targets, as used in current headlamps, allow a roadway to be illuminated up to a distance of 600 meters. However, the light/dark boundary when dimming such light sources would be too sharp, and so a different type of light source would be required for the dimmed light, for example.

Light-emitting diodes, in particular red power light-emitting diodes, which find increasing use in tail lamps, facilitate new styling concepts; however, the emission characteristic of such light-emitting diodes may have a disadvantageous effect on the visibility over a large angle range. However, a visibility over of a certain minimum angle range is demanded, for example in the ECE R7 guideline.

At the same time, there is an observable trend of increasingly using vehicle lamps as stylistic means. By way of example, characteristic lighting signatures are used in vehicle tail lamps. At the same time, there are ever more sharply defined boundary conditions here in respect of installation space and arrangement on the vehicle, for example in order to maximally exploit a loading space width. Strongly adapted optical concepts are often necessary in order to circumvent the restrictions mentioned in the aforementioned examples or in order to satisfy the boundary conditions demanded by the legislature and by the vehicle design. Conventionally, mirrors, prisms and macroscopic scattering structures are used in this case in order to realize the desired lighting devices.

Examples for lighting devices which achieve particular optical effects by means of light-emitting diodes are known from, for example, FR 2 995 978, U.S. Pat. No. 9,091,407 B1, EP 07 020 676 A1, EP 2 336 632 A1, WO 2011/113937 A1, US 2013/0010487 A1, or US 2014/0085916 A1. Light-emitting diode tail lamps of a vehicle known from such documents exhibit a 3-D effect by multiple reflections in a mirror system, which comprises a partly transmissive mirror and a mirror with substantially 100% reflection. An employed light source comprises an assembly of different light-emitting diodes in a compact housing. This form of this housing predetermines an optical form that is reflected multiple times.

An example of such a conventional apparatus is shown in FIGS. 1, 2A and 2B.

FIG. 1 illustrates a cross-sectional view of a lighting device 10, which may serve as a tail lamp for a motor vehicle. The lighting device 10 comprises rectangular light-emitting diodes 13 arranged in a housing 12, assigned to which there is a light-emission structure 14 for the directed light output in the form of a rectangle. Moreover, the lighting device 10 comprises a mirror 15 that reflects to substantially 100% and a partly reflective mirror 16. As illustrated by exemplary light rays 17, the light emitted by the light-emitting diodes 13 is reflected multiple times such that light is output multiple times by the partly reflective mirror 16, in accordance with the form of the light emitter 14.

FIGS. 2A and 2B elucidate the effect achievable thereby for two different viewing positions. In FIG. 2A, the lighting device 10 is observed from the center, as symbolized by an eye 22. Here, a plurality of rectangles that are arranged symmetrically within one another are perceived as lighting signatures 20, wherein a luminous intensity of the rectangles decreases from the outside to the center as a result of the multiple reflections. The lighting signature denoted by 21, in which the inner rectangles are displaced, arises in the case of an observation that is offset from the central axis, as illustrated in FIG. 2B and symbolized by an eye 23. Consequently, as it were, a three-dimensional observation effect can be produced.

This conventional solution has a number of disadvantages. Firstly, the lighting device is a real housing with a certain extent. The design is quickly stretched to its limits as a result of the available space in the lighting device and as a result of production requirements and a desired form complexity. Moreover, the generation of a continuous rectangular form requires a plurality of light sources, for example light-emitting diodes (e.g., approximately 30 light-emitting diodes). Moreover, the radiant intensity within each rectangle is uniformly bright. A modulation of the radiant intensity within an individual rectangle or another form is only producible with much outlay.

Other concepts, too, which operate using conventional elements such as mirrors, prisms and macroscopic scattering structures, are stretched to their limits when faced with the demand for complex boundary conditions such as, for example, viewing-angle-dependent lighting signatures, lighting signatures with a certain intensity distribution and defined projection plane or complex illumination structures with a boundary condition of a great installation space reduction.

Moreover, it would be very desirable to keep the production costs for lighting devices as low as possible and, in particular, facilitate simple mass production.

It is therefore an object of the present invention to provide lighting devices for vehicles, in which the above-described problems can be entirely or partly remedied or can at least be reduced.

To this end, a lighting device as claimed in claim 1 is provided. The dependent claims define further embodiments.

SUMMARY

According to the invention, a lighting device is provided, comprising: a light source and a refractive diffusor for producing a lighting signature on the basis of light from the light source.

Here, the refractive diffuser can be a refractive diffuser with achromatic properties.

As a result of using the refractive diffuser, a great freedom in terms of design can be obtained for the lighting device in the case of a relatively small installation space. Moreover, in contrast to diffractive diffusers, a refractive diffuser has no zero order of diffraction, avoiding an occurrence of unwanted light effects on account of the zero order of diffraction.

In its own right, a refractive diffuser is a known component, which has refractive properties on a surface. Refractive diffusers are understood to be diffusers with smooth surface profile forms, which contain no discontinuities and whose properties are dominated by the refraction of light. Typically, such diffusers have a "smooth" "free-form surface" with a statistical surface profile that is calculated by way of wave optics. In the case of such a diffuser, the light rays emitted by each location, for example, on a surface of the diffuser (the location can be specified by x, y coordinates), yield the desired lighting signature in their totality. Thus, the structures on the diffuser are determined in such a way that specifically the lighting signature arises, in particular as a geometrically defined lighting distribution. The calculation of such structures, which are also referred to as continuous or refractive phase elements, is explained, for example, in J. Néauport et al., Applied Optics, vol. 42, no. 13, pages 2377 ff or in K.-H. Brenner et al, Diffractive optics and microoptics (DOMO) 2000: Conference Edition; OSA Technical Digest, pages 237 ff, ISBN 1-55752-635-4. Achromatic properties of such elements are described in M. Cumme and A. Deparnay, Advanced Optical Technologies, vol. 4, issue 1, pages 47-61. These are based on a specific mixture of diffractive and refractive properties, in which an opposite angle dispersion is used to compensate chromatic aberrations.

Thus, this publication describes refractive diffusers with achromatic properties. On account of their specific surface structure, these avoid the occurrence of a zero order of diffraction and, in addition to their achromatic properties, have great efficiency and are therefore well suited to lighting devices for vehicles.

Here, a lighting signature should be understood to mean the perceived appearance of the light during the operation of the lighting device, said appearance, in particular, being able to have a geometrically defined lighting distribution.

By way of example, the light source can comprise a light-emitting diode and/or a laser diode, for example in combination with a phosphor target. As a result of this, a cost-effective provision of a light source with sufficient coherence is possible.

The refractive diffuser can be configured to produce the lighting signature with an inhomogeneous intensity distribution. An additional degree of freedom when designing lighting signature arises from such intensity distributions.

By way of example, the lighting signature can comprise a rectangular form, a cruciform form and/or a boomerang-shaped form. However, it is also possible to produce more complicated forms, such as star-shaped forms or nested intensity patterns. Thus, different forms are possible, yielding a great freedom in terms of design.

Additionally, the refractive diffuser can be configured in such a way that the lighting signature changes as a function of a viewing direction. This renders further optical effects possible.

The lighting device may further comprise at least one mirror for deflecting light from the light source.

As a result of a combination with the mirror, light from a light source can be steered through the diffuser multiple times, in particular, and/or with a desired focusing.

The refractive diffuser and one mirror of the at least one mirror can be embodied in integral fashion as one component. This renders a cost-effective production possible.

The mirror can comprise a first mirror and a partly reflective second mirror, which are arranged in such a way that they produce a plurality of partial light beams and steer these to the refractive diffuser. In particular, a plurality of images of the lighting signature can be produced in the case of such an arrangement with multiple reflections.

The refractive diffuser can be configured to produce a virtual image of the lighting signature in a plane between the diffuser and the light source or can be configured to produce the virtual image in the plane of the light source. In other embodiments, a real image can be produced, in particular between a lighting output surface of the lighting device and an observer.

The at least one mirror may also comprise a concave mirror for focusing light from the light source.

A concave mirror can be used to define a focal plane or a location of a real image to be produced.

By way of example, the lighting device can be embodied as a tail lamp or as a headlamp. Consequently, the invention is usable for different lighting directions of a vehicle.

BRIEF DESCRIPTION OF THE DRAWINGS

For an improved understanding, exemplary embodiments are explained in greater detail below with reference to the accompanying drawings. In the figures.

DETAILED DESCRIPTION

Various exemplary embodiments are now explained in detail below. This detailed description should not be construed as restrictive. In particular, a description of an exemplary embodiment with a multiplicity of features, components or details should not be interpreted to the effect that all these features, components and details are necessary for implementation. Variations and modifications, which were described for one of the exemplary embodiments, are also be applicable to other exemplary embodiments, provided nothing else is specified. Moreover, features of various exemplary embodiments can be combined with one another in order to form further exemplary embodiments.

Figure 3:
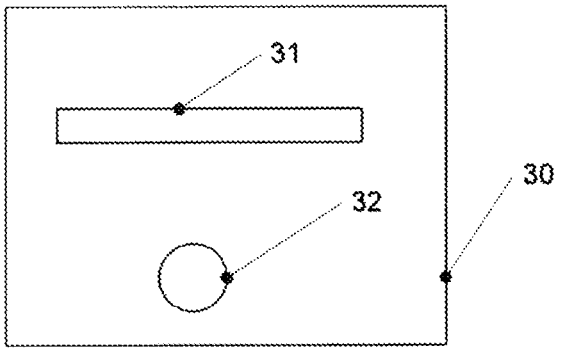
FIG. 3 shows a schematic block diagram of a lighting device according to one exemplary embodiment.

FIG. 3 shows a schematic illustration of a lighting device 30 according to one exemplary embodiment, on the basis of which some of the fundamental components of exemplary embodiments are explained. By way of example, depending on the precise implementation, the lighting device 30 is usable as a tail lamp, as a headlamp, as a stop lamp or as a direction indicator for a vehicle; however, it is not restricted thereto.

The lighting device 30 comprises a light source arrangement 32, which may comprise, e.g., one or more light-emitting diodes, in particular power light-emitting diodes, or else laser light sources in combination with phosphor targets. Moreover, the lighting device 30 of FIG. 3 comprises a refractive diffuser 31, in particular a refractive diffuser with achromatic properties. As already mentioned, such a diffuser is described in "Advanced Optical Technologies", vol. 4, no. 1, pages 47-61, for example. Beam shaping of the light from the light source arrangement 32 can be achieved by means of the diffuser 31. In particular, one or more virtual or real images can be produced, said images having desired forms and/or desired intensity distributions. This facilitates a greater freedom in terms of the design of a lighting signature of the lighting device 30 than in the case of the conventional approaches mentioned at the outset.

The mode of operation and structure of such a refractive diffuser is now explained with reference to FIGS. 4A and 4B, and also FIGS. 12A-12C.

Figure 4A:
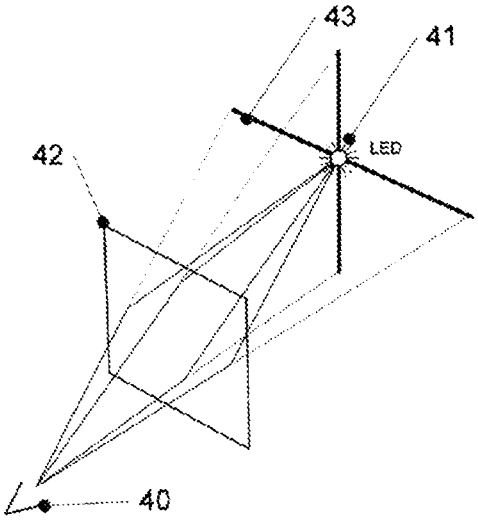
FIGS. 4A and 4B show illustrations for elucidating schematic refractive diffusers.

As shown in FIG. 4A, a diffuser 42 produces a virtual image 43 when illuminated by suitable light from a light source 41, said image lying in a plane, parallel to a plane of the diffuser 42, through the light source 41. In other exemplary embodiments, the virtual image can lie in a plane between the light source 41 and diffuser 42. In particular, the diffuser 42 is a refractive diffuser with achromatic properties. In the illustrated example, the virtual image 43 is cruciform. However, there is great freedom when designing the form of the virtual image and other forms may also be provided. Then, the virtual image 43 is perceived by an eye 40 of an observer.

Figure 4B:
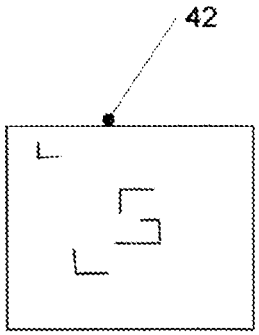

FIG. 4B illustrates an example of a height profile of such a diffuser 42. The diffuser 42 has a continuous surface profile, which is calculated depending on the desired form of the image 43. Since a refractive diffuser in the arrangement of FIG. 4A generates a virtual image, the produced light forms may lie on the optical axis, i.e., the light appears in the center in the case of a central viewing.

Here, those structures of the refractive diffuser 42 that are situated in a certain region about the optical axis are decisive and necessary for the production of the virtual image 43. Here, the optical axis is the line connecting the eye 40 of the observer and the light source 41. The size of the certain region is defined by the maximum deflection angles of the refractive structures situated therein, specifically in such a way that only those structures that still deflect the light from the light source 41 to the eye 40 lie in the certain region.

If there is a change in the viewing direction, for example as a result of a displacement in the position of the eye, there is also displacement of the optical axis and consequently of this certain region, which contains the structures necessary for producing the perceived virtual image. If these structures of the refractive diffuser 42 consist of periodically repeated unit cells with an identical angle spectrum (i.e., identical deflection of the rays from the light source to the eye), for example, there is no change in the virtual image when the viewing direction changes since, although there is a change in the certain region of the structures of the refractive diffuser 42 that are relevant for the respective image production, there is no change in the angle spectrum of light rays produced by these structures in the certain region and consequently there is no change in the perceived virtual image.

In other exemplary embodiments, the refractive diffuser is constructed precisely in such a way that the virtual image changes with the viewing direction. An example of this is illustrated in FIGS. 12A to 12C. Here, FIGS. 12A to 12C show an arrangement with a refractive diffuser 121 and a light source 122 for three different viewing directions corresponding to three different positions of an eye 120 relative to the refractive diffuser 121. Structures 124A, 124B and 124C are indicated in the diffuser 121 by way of example, said structures deflecting light from the light source 122 to the eye in different ways.

Figure 12A:
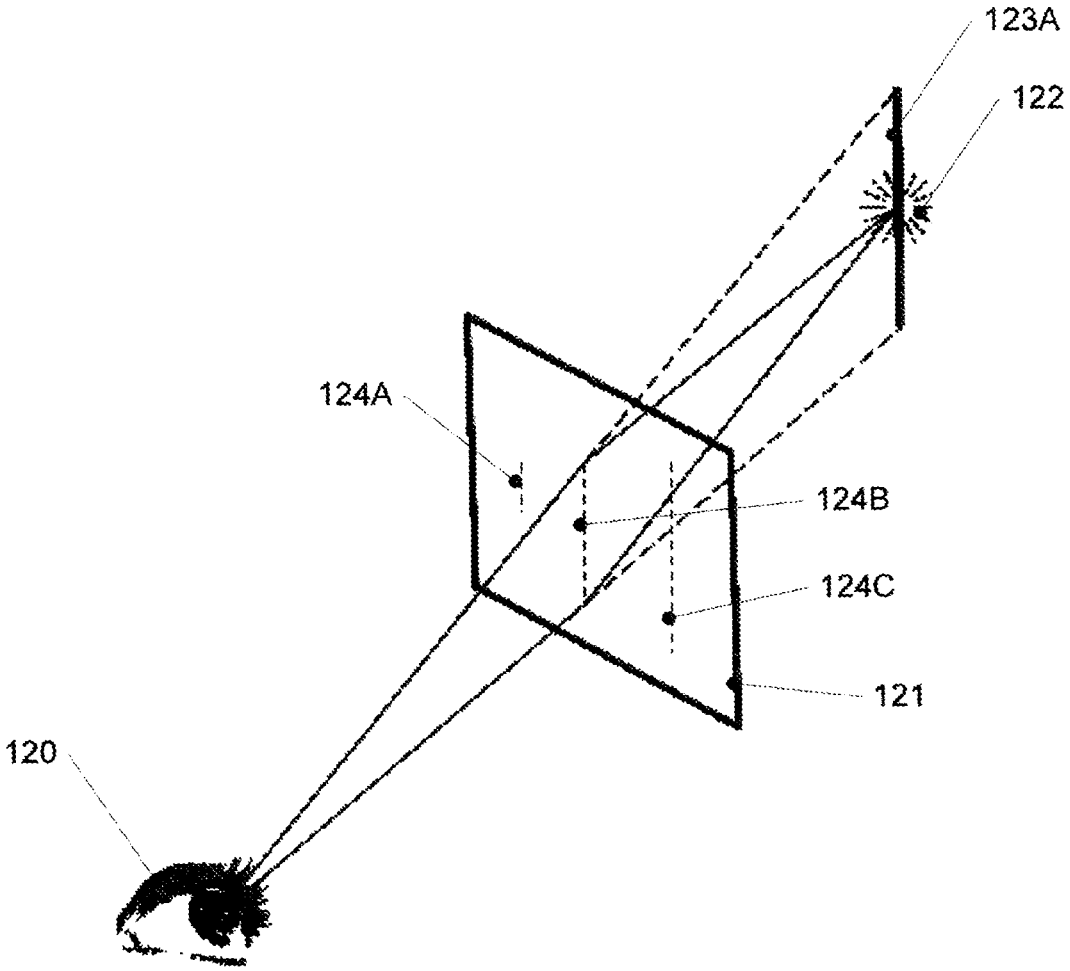
FIGS. 12A-12C show an illustration for explaining lighting signatures that are dependent on a viewing direction.

In the example of FIG. 12A, the structures 124A are in the aforementioned certain region, i.e., light of the light source 122, which is incident on the structures 124A, is deflected to the eye 120, producing a virtual image in the form of a bar 123A. Light from the light source 122 incident on the structures 124B and 124C does not reach the eye 120 in the position illustrated in FIG. 12A on account of the angle characteristics of these structures.

Figure 12B:
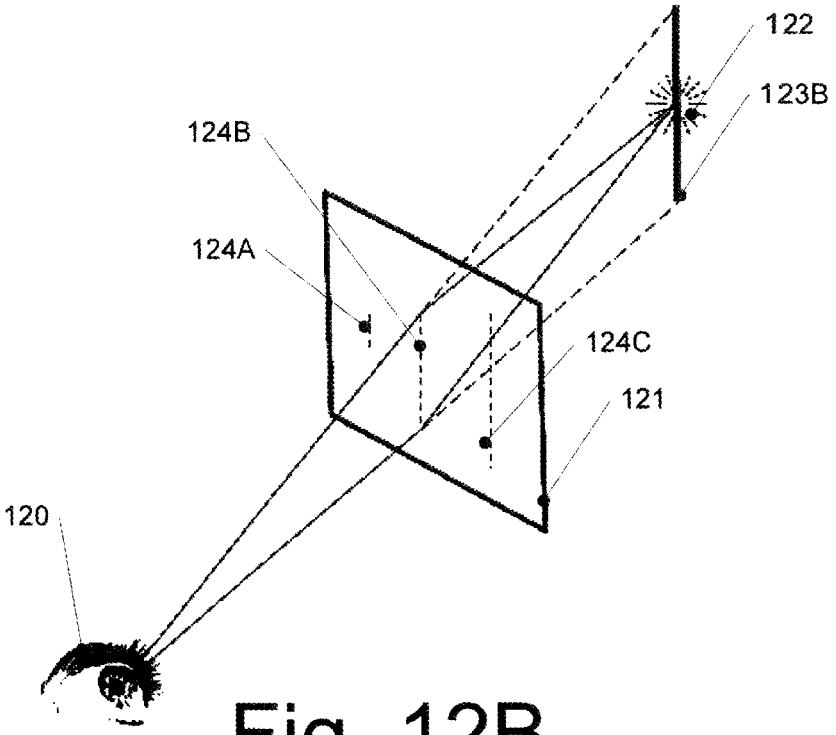
Figure 12C:
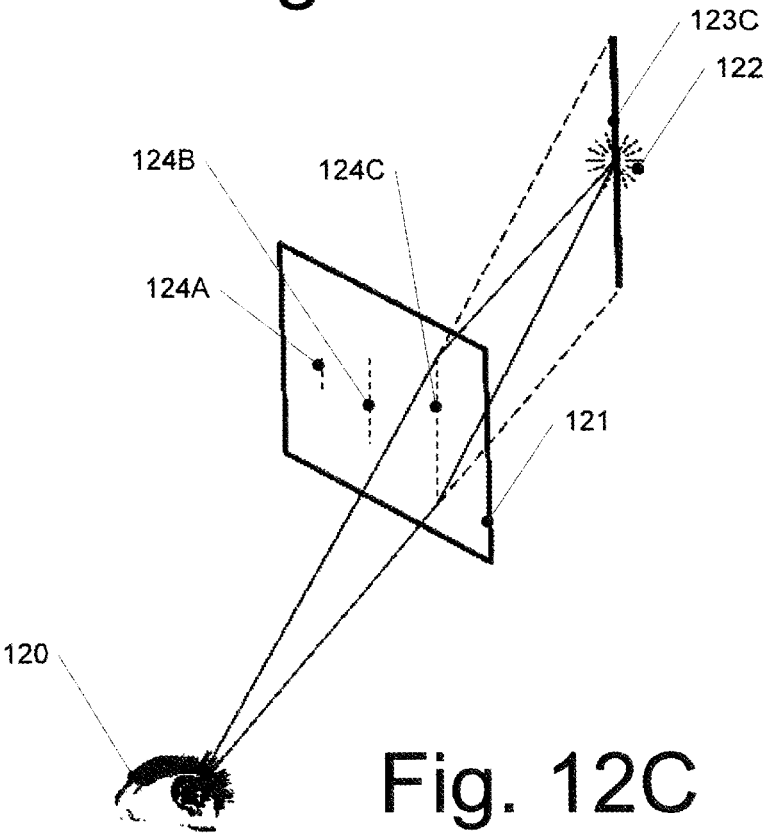

By contrast, in the position of the eye 120 as in FIG. 12B, the structure 124B is in the certain region from which the light from the light source 122 is steered to the eye 120, and said structure produces a virtual image in the form of a bar 123B which is significantly longer than the bar 123A in FIG. 12A. Finally, in the position of the eye 120 as in FIG. 12C, light is steered to the eye 120 from the structures 124C, leading to a virtual image in the form of a bar 123C which is even longer than the bar 123B.

Consequently, there is a change in the virtual image, the length of the bar in this example, depending on the viewing direction. However, other changes are possible, in particular more complex changes, such as a change in the perceived form of the lighting signature, for example changeable stars, crosses, ring figures or circular figures. To this end, the refractive structures are arranged in such a way that the angle spectrum produced thereby changes over the area of the diffuser in a manner adapted to the desired lighting signatures to be perceived.

Now, more specific implementation examples of lighting devices with a refractive diffuser are described below.

Figure 1:
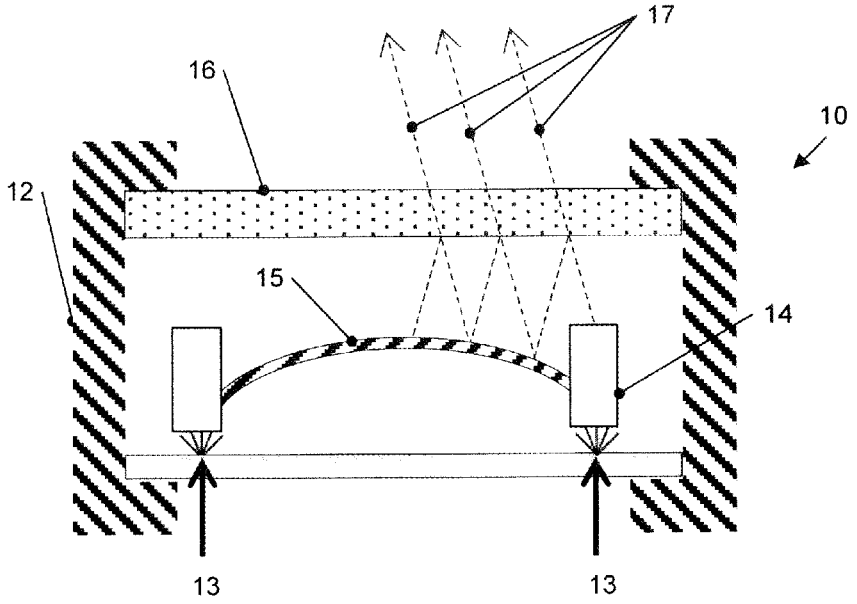
Fig. 1 (Prior art)
FIG. 1 shows a cross-sectional view of a conventional lighting device.
Figures 2A, 2B:
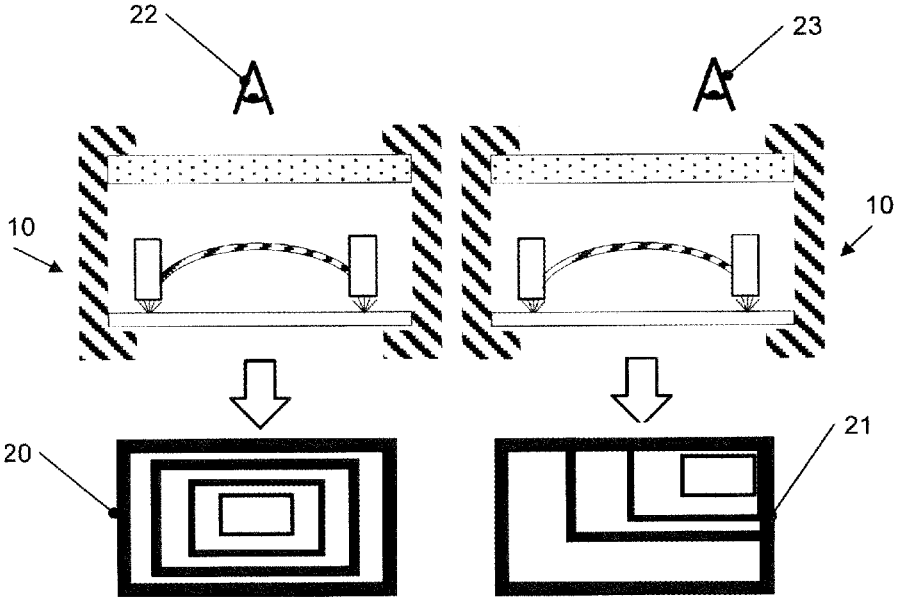
Fig. 2A Fig. 2B (Prior art)
FIGS. 2A and 2B show examples of lighting signatures of the lighting device from FIG. 1 in the case of different viewing directions.
Figure 5B:
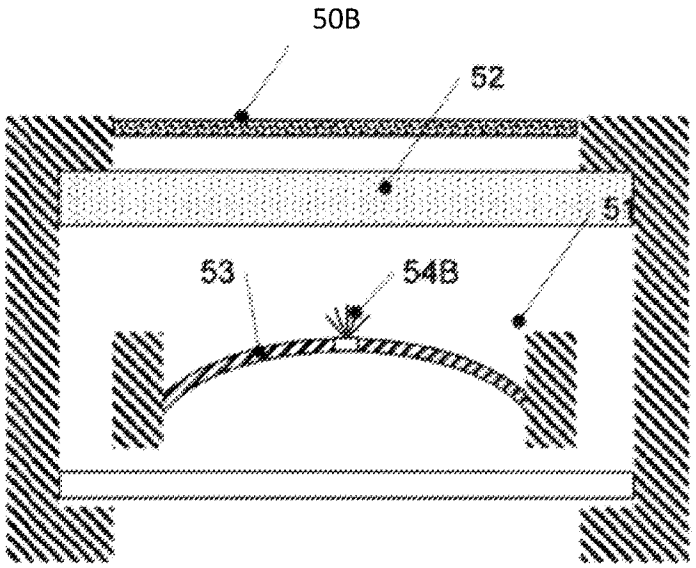
FIGS. 5A and 5B show illustrations of a lighting device according to one exemplary embodiment.
Figure 5D:
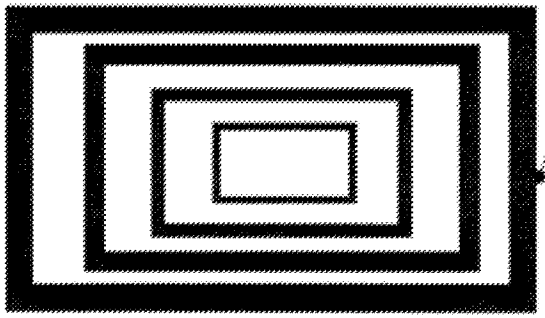
FIGS. 5C and 5D show corresponding lighting signatures.
Figure 5A:
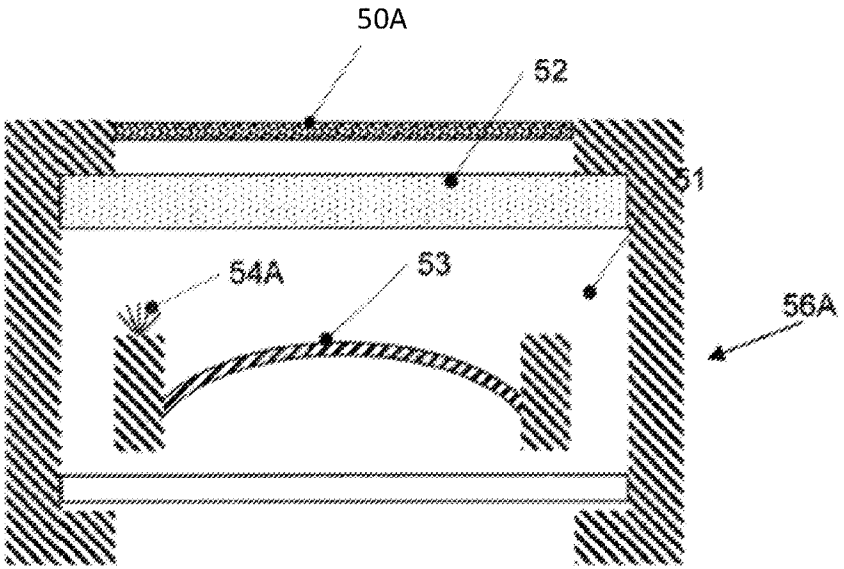
Figure 5C:
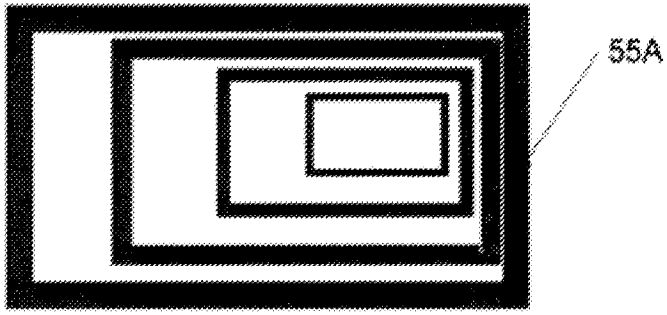

FIGS. 5A and 5B illustrate cross-sectional views of lighting devices which are based on the conventional lighting device discussed at the outset with reference to FIGS. 1 and 2. The lighting devices of FIGS. 5A and 5B merely differ in respect of the position of a light source, and otherwise have structures that correspond to one another. FIGS. 5C and 5D show possible lighting signatures of the exemplary embodiments of FIGS. 5A and 5B.

In FIG. 5A, a mirror 53 which exhibits at least substantially complete reflection and a partly transmissive mirror 52 are arranged in a housing in the case of a lighting device 56A, similar to the lighting device 10 of FIG. 1. Furthermore, the lighting device 56A has a light-emitting diode 54A as a light source. In particular, the light-emitting diode 54A can be a power light-emitting diode with a sufficiently high intensity. Here, in the exemplary embodiment of FIG. 5A, the light-emitting diode 54A has a lateral offset, i.e., an offset in relation to the central axis.

In the exemplary embodiment of FIG. 5A, a desired form of the lighting signature, a rectangle, for example, is produced not by an arrangement of a multiplicity of light-emitting diodes like in the prior art of FIG. 1, but by a refractive diffusive 50A, which is configured to produce a desired form, e.g., rectangular form, in the far field.

As a result of this, only a single light-emitting diode is needed as a light source. Moreover, there is greater freedom in terms of the design of the desired form of the lighting signature, and the rectangle should be merely understood as exemplary in this case.

FIG. 5B shows a development of the exemplary embodiment of FIG. 5A; the same elements are provided with the same reference signs and not explained again. Rather, the differences to FIG. 5A are explained.

In contrast to FIG. 5A, a light-emitting diode 54B is arranged centrally in the case of a lighting device 56B of FIG. 5B. Provision is once again made of a diffuser 50B which, in comparison with the diffuser 50A, may be adapted to the modified position of the light-emitting diode 54B and which, in turn, is configured to produce a desired form, e.g., a rectangular form, in the far field.

Both in FIG. 5A and in FIG. 5B, the light of the light-emitting diode 54A and 54B, respectively, is reflected multiple times between the mirrors 52 and 53 in this case, with the mirror 52 in each case passing some of the light. Then, different rectangles are "formed" in the far field by the diffusers 50A and 50B, respectively, from the respective output coupled light.

FIGS. 5C and 5D show examples of arising lighting signatures. The lighting signature 55A has a plurality of nested rectangles, which are not arranged centrally in relation to one another. By way of example, such a signature may arise when looking straight at the lighting device 56A of FIG. 5A or the lighting device 56B of FIG. 5B. FIG. 5D shows a lighting signature 55B with rectangles arranged centrally in relation to one another, as may arise, for example, from looking obliquely at the lighting device 56B of FIG. 5B or the lighting device 56A of FIG. 5A.

In contrast to the lighting devices explained in relation to FIGS. 1 and 2, the largest light form in this case, i.e., the largest rectangle in the illustrated example, can be seen in a plane in the background of the observer that is furthest away, while the smallest rectangle appears closest to the observer. Moreover, in contrast to the lighting device of FIGS. 1 and 2, the smallest rectangle is brightest in this case.

This intensity distribution arises if use is made of a continuous partly reflective mirror 52. In order to distribute the light intensities as a result of the plurality of reflections differently, the use of an arrangement with a plurality of partly transmissive mirrors with a small transmission factor (5% or 10%) or with changing transmission factors is also possible in other exemplary embodiments.

Figure 6B:
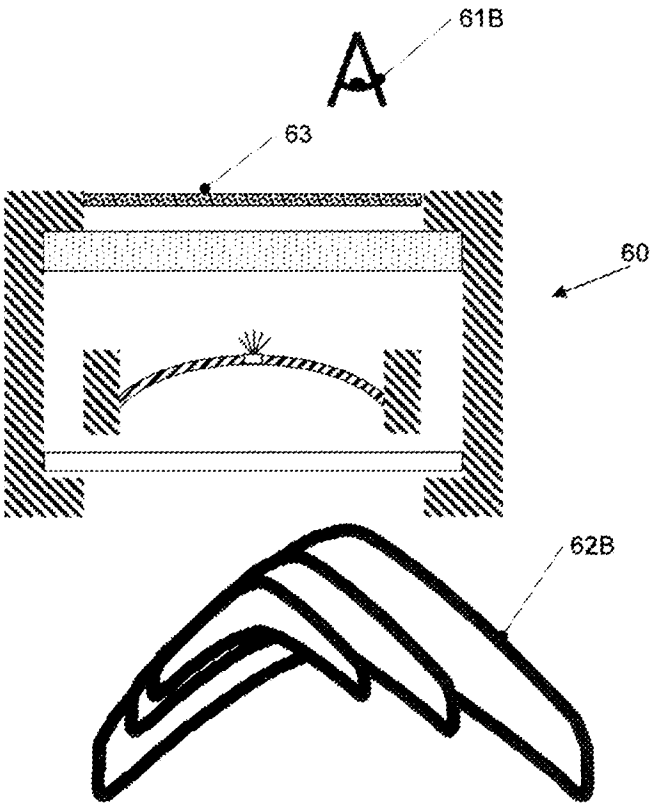
FIGS. 6A and 6B show illustrations of a lighting device according to a further exemplary embodiment.
Figure 6A:
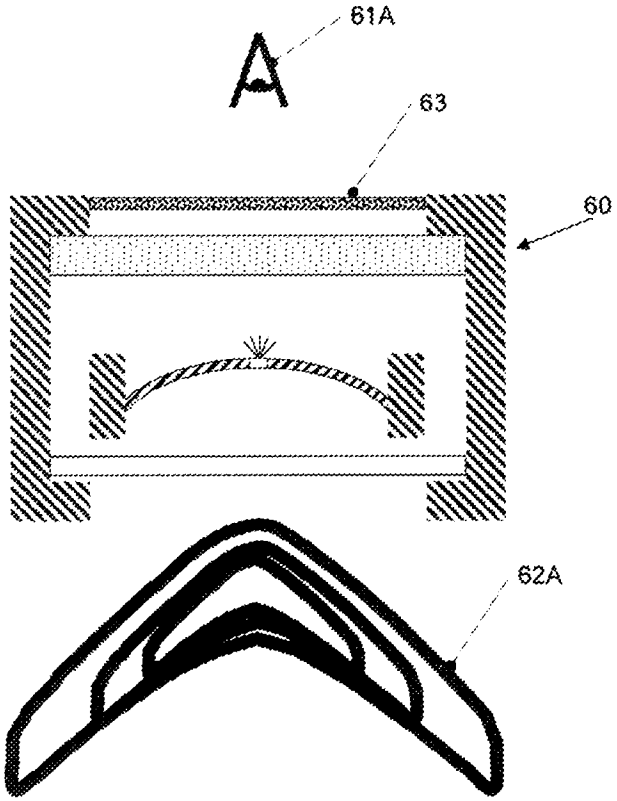

In particular, the use of a refractive diffuser allows great freedom in terms of design in respect of the form of the light signature. In particular, this is not restricted to rectangles as shown in FIG. 5. Further options will now be described with reference to FIGS. 6 and 7. Here, FIGS. 6A and 6B show a lighting device 60 which largely has the same structure as the lighting device 56B of FIG. 5B. As a difference, the diffuser 50B of FIG. 5B has been replaced by a diffuser 63 that is configured to produce a boomerang-shaped lighting signature instead of the rectangular lighting signature of the diffuser 50. Here, the lighting device 60 has a centrally arranged light source, corresponding to the light source 54B of FIG. 5B. In a development, a light source may also be arranged at the edge of the lighting device, corresponding to the light source 54A of FIG. 5A.

FIGS. 6A and 6B show examples of arising lighting signatures for two different viewing directions. Here, FIG. 6A shows an example for a lighting signature 62A in the case of a central observation, as indicated by an eye 61A. FIG. 6B shows the corresponding lighting signature 62B in the case of a lateral or oblique observation, as indicated by an eye 61B. Like in FIG. 5, the basic form of the lighting signature arises in different sizes in this case, with the basic form being a boomerang in this case. Moreover, the boomerang form in the example of FIG. 6 has a uniformity variation, i.e., the form has bright zones and less bright zones.

Figure 7:
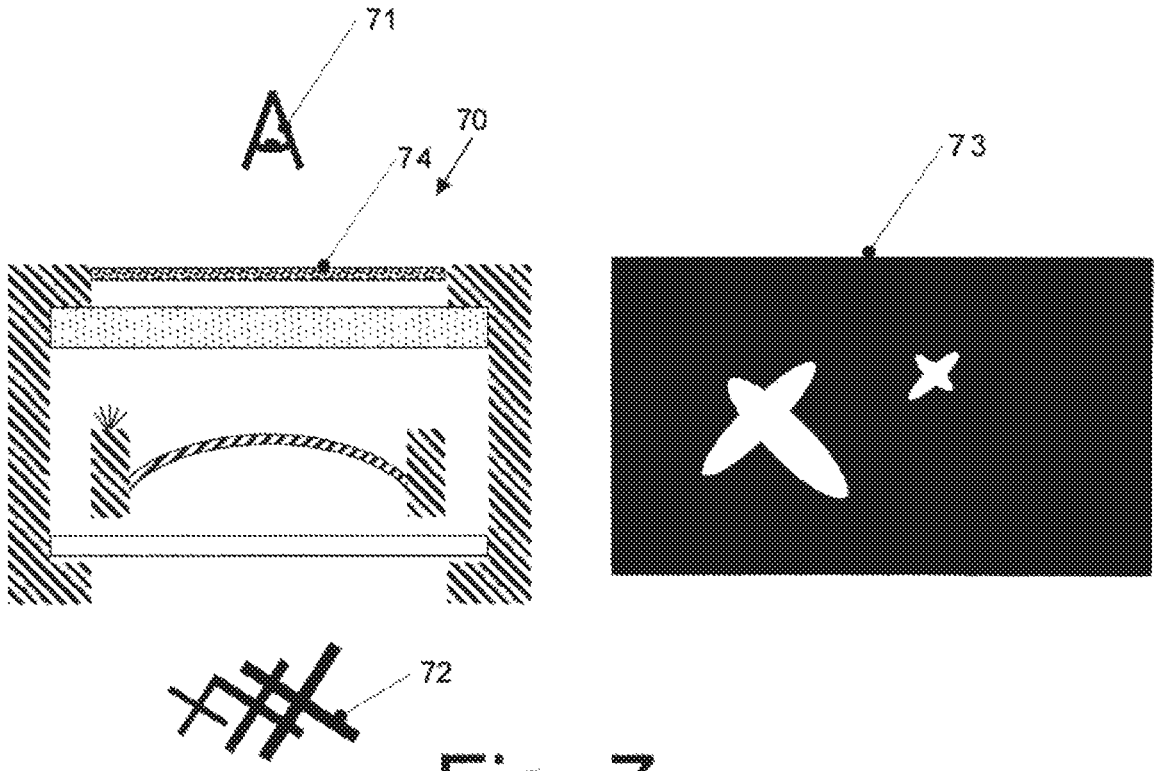
FIG. 7 shows an illustration of a lighting device according to a further exemplary embodiment.

A further example is illustrated in FIG. 7. FIG. 7 shows a lighting device 70, which is embodied in a manner corresponding to the lighting device 56A of FIG. 5A (with a light source arranged on the edge). Instead of the refractive diffuser 50 of FIG. 5A, the lighting device 70 of FIG. 7 has a refractive diffuser 74, which is configured to produce a cruciform lighting signature. An exemplary result in the case of the face-on observation as indicated by an eye 71 is denoted by 72. The smallest cross (illustrated on the left at 72) is the brightest in this case and appears in the foreground, while the largest cross (on the right at 72) is the darkest and appears on the right. A photographic record of a corresponding image is denoted by 73. Here, the diffuser additionally has such a configuration that the crosses have a light modulation. In particular, the crosses in the illustrated example appear brighter in the center than at the edge. Other types of light modulation are also possible. Moreover, such light modulations can also be used in other forms, for example the rectangular form of FIG. 5 or the boomerang-shaped form of FIG. 6. Thus, there is great freedom in terms of the design in this case by way of an appropriate configuration of a refractive diffuser.

The exemplary embodiments discussed with reference to FIGS. 5 to 7 use a multiple reflection and are particularly suitable for tail lamps of a vehicle. Tail lamps without multiple reflections, i.e., without the illustrated mirrors, are also possible. In this case, a single form of the lighting signature, for example a single boomerang, a single rectangle or a single cross is produced. Moreover, refractive diffusers can also be used for other types of lighting devices in vehicles. By way of example, lighting devices are illustrated with reference to FIGS. 8 to 11, which lighting devices are used as headlamps or parts thereof, for example as a full beam, dipped beam or daylight running light.

Figure 8:
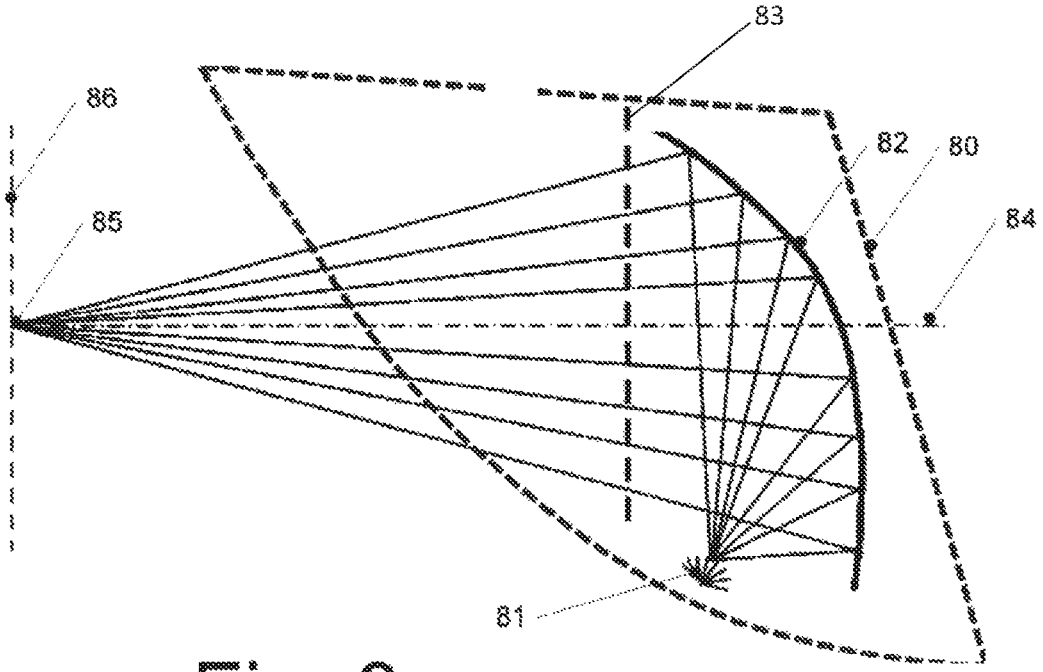
FIG. 8 shows an illustration of a lighting device according to a further exemplary embodiment.

FIG. 8 illustrates a schematic illustration of a vehicle headlamp 80 of one exemplary embodiment. The exemplary embodiment of FIG. 8 comprises a light source 81. The light source 81 may comprise a laser diode in combination with a phosphor target, for example; however, it may also comprise any other type of light source, such as, e.g., a light-emitting diode, a white-light light-emitting diode or a combination of a plurality of such light sources. Light from the light source 81 is incident on a concave mirror 82, which is configured to focus the light at a focus 85 in a projection plane 86.

In contrast to conventional headlamps, the headlamp 80 of FIG. 8 additionally has a refractive diffuser 83, which is arranged between the concave mirror 82 and the projection plane 86. Such refractive diffusers can be produced cheaply, for example by injection molding techniques.

Figure 9:
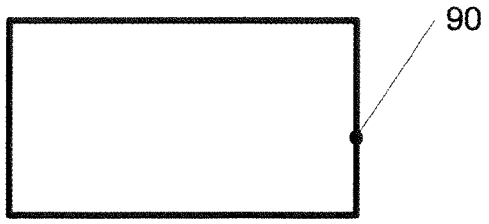
FIG. 9 shows an illustration of a possible lighting signature of the apparatus of FIG. 8.

At the focus or around the focus in the projection plane 86, the diffuser 83 produces a desired light distribution, i.e., a desired lighting signature of the lighting device, which can be chosen as desired by way of an appropriate configuration of the diffuser 83 as already explained in the preceding exemplary embodiments. As an example, FIG. 9 shows a rectangular distribution 90. However, any other distribution is also possible, such as, e.g., triangles, squares, stars or other forms, even more complex forms. Depending on the focal length of the concave mirror 82, the projection plane 86 or the focus 85 may lie outside of the headlamp 80 (as illustrated) or within the headlamp. By way of example, the distance between the diffuser 83 and the projection plane 86 can be between 2 and 10 cm, for example approximately 5 cm. However, these numerical values should only be understood as exemplary. Here, the lighting signature is produced as a real image which, for example, is situated outside of the vehicle in the space in front of the lighting apparatus. As discussed above with reference to FIG. 11, a diffuser 83 can also be used in the exemplary embodiment of FIG. 9, said diffuser being configured in such a way that there is a change in the lighting signature when the viewing direction changes, as discussed using the example of a changeable bar in FIGS. 12A-12C.

The diffuser itself may be configured in turn as described in the documents mentioned at the outset.

Figure 10:
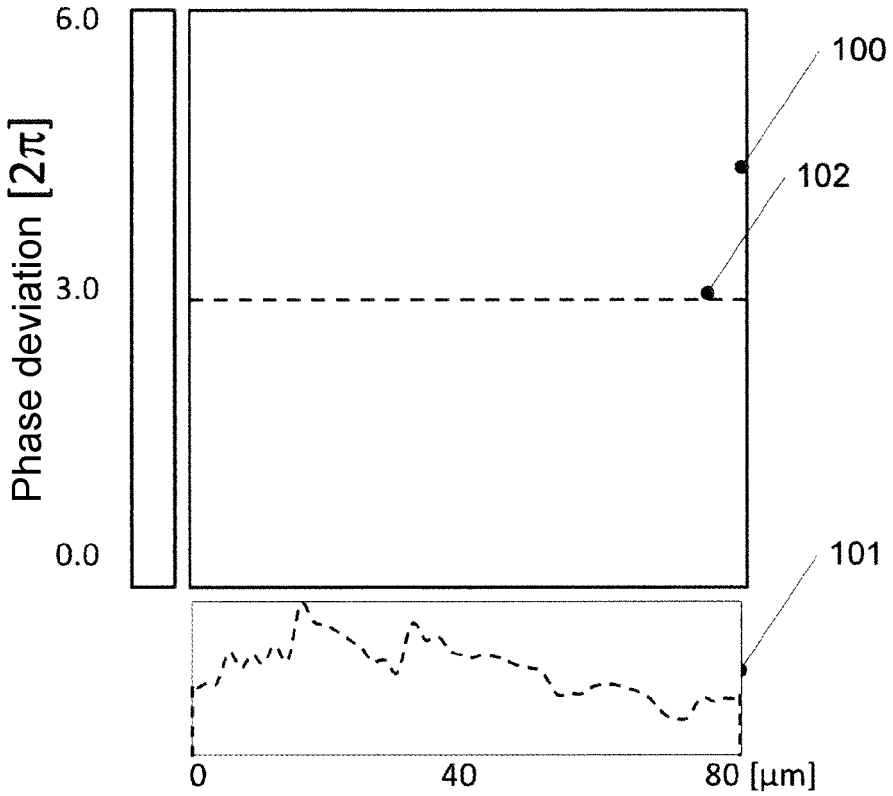
FIG. 10 shows an illustration of part of a refractive diffuser, which is usable in the apparatus of FIG. 8.

FIG. 10 shows a portion of a calculated phase distribution for a refractive diffuser for producing a rectangular signature as illustrated in FIG. 9. A plan view of part of the phase distribution of the diffuser is denoted by 100, with the phase deviation being illustrated in units of 27. A graph 101 shows a cross section of the phase distribution along a line 102 in the representation 100. Here, the calculation was carried out for a wavelength of 630 nm and a coherence length of 30 nm. Depending on the desired lighting signature, desired wavelength and coherence length, the phase distribution may differ from implementation to implementation.

Figure 11:
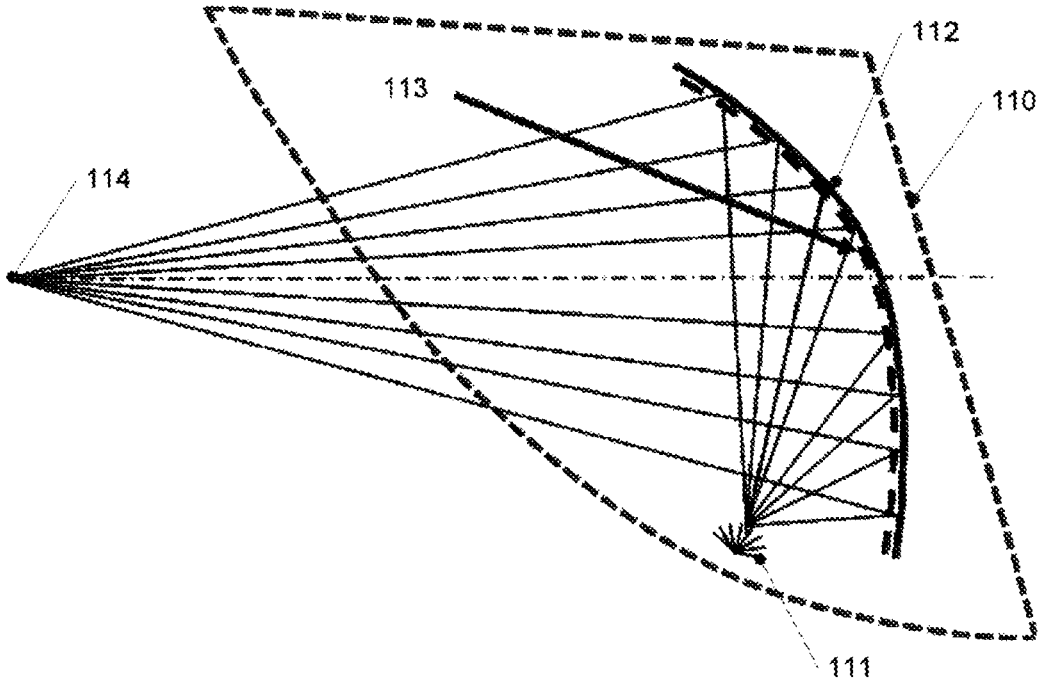
FIG. 11 shows an illustration of a lighting device according to a further exemplary embodiment.

The concave mirror 82 and the diffuser 83 are separate components in the exemplary embodiment of FIG. 8. A diffuser structure may also be provided on a mirror surface in other exemplary embodiments. In this case, the concave mirror and diffuser structure then can be produced in a single injection molding method. A corresponding exemplary embodiment is illustrated in FIG. 11. FIG. 11 shows a headlamp 110 with a light source 111, which may be configured in a manner corresponding to the light source 81 of FIG. 8. Moreover, the headlamp 110 comprises a concave mirror 112, a refractive diffuser 113 being embodied on the reflective surface thereof such that the concave mirror 112 and diffuser 113 form a single component. The concave mirror 112 images the light rays emanating from the light source on a focus 114. Then, the lighting signature determined by the diffuser 113 is produced in a corresponding projection plane through the focus. Apart from the provision of the diffuser 113 directly on the surface of the concave mirror 112, the functionality of the exemplary embodiment of FIG. 11 corresponds to the functionality of the exemplary embodiment of FIG. 8 and the various variations and explanations that were made in respect of the exemplary embodiment of FIG. 8 are also applicable to the exemplary embodiment of FIG. 11.

It should be noted that such an integral embodiment of diffuser and mirror is also possible in other exemplary embodiments. Thus, for example, the diffuser 50 can be embodied on the partly transmissive mirror 52 in the exemplary embodiment of FIG. 5.

Consequently, different types of lighting devices for vehicles, in particular tail lamps and headlamps, but also direction indicators, stop lamps and the like, can be provided with desired light signatures by means of refractive diffusers, enabling a great freedom in terms of design.

The invention claimed is:

1. A lighting device for a vehicle, comprising:

a light source and a refractive diffuser for generating a lighting signature on the basis of light from the light source, wherein the lighting signature is a geometrically defined lighting distribution as perceived by an observer viewing the lighting device from a far-field perspective;

wherein the refractive diffuser is configured to generate the lighting signature with an inhomogeneous intensity distribution; and wherein the lighting device is embodied as a tail lamp or as a headlamp of the vehicle.

2. The lighting device as claimed in claim 1, wherein the refractive diffuser is a refractive diffuser with achromatic properties.

3. The lighting device as claimed in claim 1, when the light source comprises at least one of a light-emitting diode or a laser diode.

4. The lighting device as claimed in claim 1, wherein the lighting signature comprises at least one of a rectangular form, a cruciform form or a boomerang-shaped form.

5. The lighting device as claimed in claim 1, wherein the lighting device includes a plurality of reflective surfaces internal to the lighting device that are configured to reflect light from the light source into the refractive diffuser at different angles, thereby resulting in the lighting signature changing as a function of a viewing direction of the observer.

6. The lighting device as claimed in claim 1, further comprising at least one mirror for deflecting light from the light source into the refractive diffuser.

7. The lighting device as claimed in claim 6, wherein the refractive diffuser and a mirror of the at least one mirror are embodied in integral fashion as one component.

8. The lighting device as claimed in claim 6, wherein the mirror comprises a first mirror and a partly reflective second mirror, which are arranged in such a way that they produce a plurality of partial light beams and steer these to the refractive diffuser.

9. The lighting device as claimed in claim 1, wherein the refractive diffuser is configured to produce the lighting signature as a virtual image, as perceived by the observer, where the virtual image lies in a plane of the light source in a plane between the light source and the refractive diffuser.

10. The lighting device as claimed in claim 6, wherein the at least one mirror comprises a concave mirror for focusing light from the light source into the refractive diffuser.

* * * * *